United States Patent [19]

Davis

[11] 4,329,639

[45] May 11, 1982

[54] LOW VOLTAGE CURRENT MIRROR

[75] Inventor: Walter L. Davis, Plantation, Fla.

[73] Assignee: Motorola, Inc., Schaumburg, Ill.

[21] Appl. No.: 124,178

[22] Filed: Feb. 25, 1980

[51] Int. Cl.[3] ..... G05F 3/20

[52] U.S. Cl. ..... 323/315; 307/297; 330/288

[58] Field of Search ..... 323/1, 4, 22 T, 312, 323/315, 316; 307/296 R, 297; 330/257, 261, 288, 290, 296

[56] References Cited

U.S. PATENT DOCUMENTS 3,813,607 5/1974 Voorman ..... 323/4

3,843,933 10/1974 Ahmed ..... 323/4

4,008,441 2/1977 Schade, Jr. ..... 330/288

*Primary Examiner*—William M. Shoop

*Assistant Examiner*—Peter S. Wong

*Attorney, Agent, or Firm*—Margaret Marsh Parker; Edward M. Roney; James W. Gillman

[57] ABSTRACT

A highly accurate current mirror for IC implementation is comprised of low beta transistors and operates on a low supply voltage by utilizing a bias network with a balance sensing feedback network to control the bias voltage. The output current of one of the mirror transistors is compared with the reference current and the level of the current is then forced to equal the reference by means of the bias voltage adjustment.

7 Claims, 4 Drawing Figures

LOW VOLTAGE CURRENT MIRROR

BACKGROUND OF THE INVENTION

This invention relates to the field of current mirror circuits and, more particularly, to the provision of an accurate current mirror operating on a minimum supply voltage.

Current mirrors are well known in the art as a means for supplying a known current as, for example, in biasing transistor gain stages. While a "current source" may be as simple as a resistor, current mirrors have become increasingly used for several reasons. First, they offer improved circuit performance and more accurate current control than do resistors, and may also require less area on an integrated circuit chip. The most conventional and simple circuit for a current mirror requires high beta transistors, or at least transistors having consistent values of beta, in order to approach the desired correlation between output and reference current. In IC processing, this is, of course, difficult and thus expensive as beta values tend to have a wide range of values and restriction of the usable range of values makes for a low IC production yield.

More complicated current mirror circuits have been devised which are less sensitive to beta variations. One such is known as the Wilson current mirror which decreases the sensitivity to beta value by means of an additional buffer transistor which supplies the base current for the mirror circuit transistors without significantly disturbing the reference current. In such a circuit, however, a high supply voltage is required, due to the series-connected emitter-base junctions. This limitation precludes the use of such a circuit in many of today's miniature electronic devices such as hearing aides, pagers, etc.

SUMMARY OF THE INVENTION

It is therefore an object of the present invention to provide a highly accurate current mirror circuit for use with low voltage supplies.

It is a particular object to provide such a circuit which is highly independent of the beta values in an integrated circuit application.

These objects and others which will become apparent are provided in a current mirror circuit wherein the two matched transistor devices are biased by an automatically controlled biasing network. A sensing circuit compares the current in one of the transistors with the reference current and adjusts the biasing voltage, forcing the collector current of that transistor to be equal to the reference current. In this mirror circuit, there are no bias paths containing more than one diode drop, thus the circuit can operate with supply voltages ranging down to 1.0 volts.

DETAILED DESCRIPTION OF A PREFERRED EMBODIMENT

Figure 1:
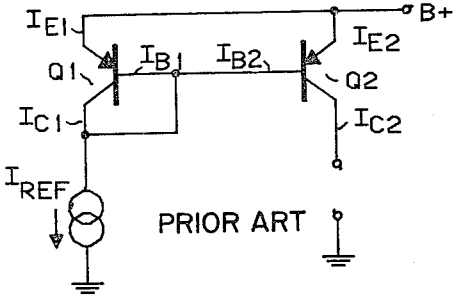
FIG. 1 is a schematic diagram of a conventional prior art current mirror circuit.

FIG. 1 shows a schematic diagram of a typical current mirror circuit as is well known in the art, and is given here to serve as a reference only. It consists of matched transistors Q1, Q2 and a current reference source $I_{REF}$. Q1 is diode-connected and is coupled to the reference current. The collector current of Q2 ($I_{C2}$) is the output current of the circuit. Since the emitter current in a bipolar transistor is a function of the emitter-base junction saturation current density, the area of that junction, electronic charge, the base-emitter voltage, Boltzmann's constant, and the absolute temperature, it is apparent that, for transistors of the same conductivity type on one IC chip, the only variable between emitter currents is the emitter-base junction area; i.e., $I_{E2}=NI_{E1}$, where N is the ratio of the two emitter-base junction areas.

Since $I_{B1}=I_{E1}/(\beta+1)$, $I_{B2}=NI_{E1}/(\beta+1)$ and $\beta=I_C/I_B$, then $I_{REF}=I_{C1}+I_{B1}+I_{B2}=\beta I_{B1}+I_{B1}+NI_{B1}$, and $I_{C2}=\beta I_{B2}=\beta NI_{B1}$. Therefore, $$\frac{I_{C2}}{I_{REF}}=\frac{\beta NI_{B1}}{\beta I_{B1}+I_{B1}+NI_{B1}}=\frac{N}{1+(N+1)/\beta}$$

Thus, $I_{C2}=NI_{REF}/[1+(N+1)/\beta]$, and only for large values of beta does $I_{C2}$ closely approximate $NI_{REF}$ and the error increases as N increases.

Figure 2:
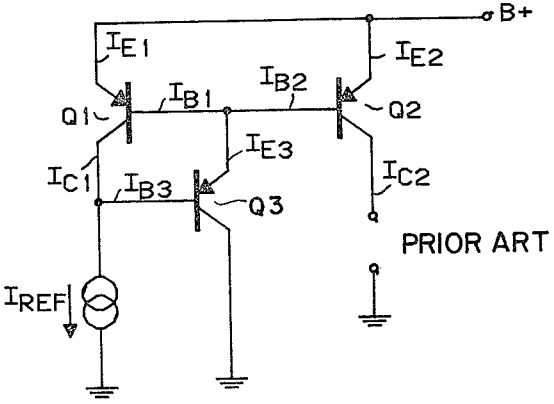
FIG. 2 is a schematic diagram of a Wilson prior art current mirror circuit.

In the current mirror of FIG. 2, commonly known as the Wilson current mirror, $$\frac{I_{OUT}}{I_{REF}}=\frac{N}{1+\frac{(N+1)}{\beta(\beta+1)}}$$

the variation of $I_{C2}$ with beta has been reduced by the buffering action of Q3, (replacing the Q1 diode connection with the Q3 base-emitter junction) which supplies the base current for Q1 and Q2 without significantly disturbing the reference circuit. However, since the two diode drops are in series, the use of this mirror structure requires a supply voltage of at least 2 volts, which is more than is available in many miniature electronic devices.

Figure 3:
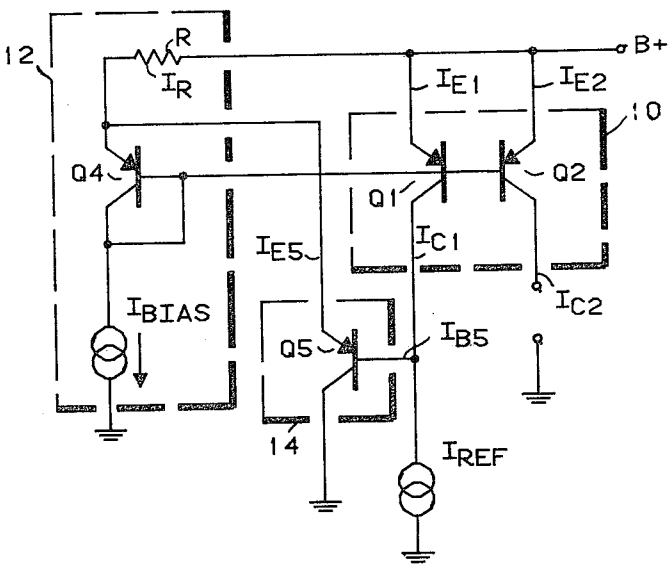
FIG. 3 is a schematic drawing of the current mirror circuit of the present invention.

The circuit of the present invention as shown in the preferred embodiment of FIG. 3, provides the advantages of both the two previously described circuits and the disadvantages of neither; i.e., it provides the same accuracy as the latter circuit with the low voltage requirement of the former.

Again, transistors Q1 and Q2 (within dashed line 10) are two matched devices, i.e. having the same conductivity type and characteristics, preferably on a single chip. Both Q1 and Q2 are initially biased by a biasing network 12 consisting of R, Q4 and a current source $I_{BIAS}$. Q1 is coupled to the reference source $I_{REF}$ as before. A balance sensing circuit 14 such as transistor Q5, compares $I_{C1}$ and $I_{REF}$ and adjusts the mirror circuit bias voltage until the two currents are equal. Since Q1 and Q2 have matching characteristics, $I_{C2}$ is forced to equal $Ni_{REF}$, N being the ratio of the two-base emitter junction areas.

More specifically, $I_{BIAS}$ establishes a voltage drop across the combination of the diode-connected transistor Q4 and the resistor R that biases the base-emitter junctions of transistors Q1, Q2. The bias network parameters, namely the value of the current source $I_{BIAS}$, the value of R and the voltage drop across Q4 at the bias current level are selected so that, if transistors Q1 and Q2 require no base current (if they had infinite beta), the base to emitter voltage of transistors Q1, Q2 would correspond to the value needed to establish an emitter current of $I_{REF}$ in Q1 and $NI_{REF}$ in Q2.

For finite values of transistor beta, transistors Q1, Q2 will draw base current from the current source $I_{BIAS}$, with the result that less current will flow through Q4 and resistor R. In consequence, the collector current of Q1 will be less than $I_{REF}$. Transistor Q5 serves to measure this imbalance between the mirror current, the excess currents is the base current for Q5, which is multiplied by the beta of Q5 and applied to the resistor R of the bias network 12.

The current through R that is applied by transistor Q5 serves to increase the base-emitter voltage of Q1 and Q2, and raises the value of the mirror current until it very closely approximates the value of the reference current. It can be shown then that, $$\frac{I_{C2}}{I_{REF}} = \frac{N}{1 + \frac{(N+1)}{\beta(\beta+1)}}$$

It will be noted that this is the same expression given above for the Wilson current mirror.

Figure 4:
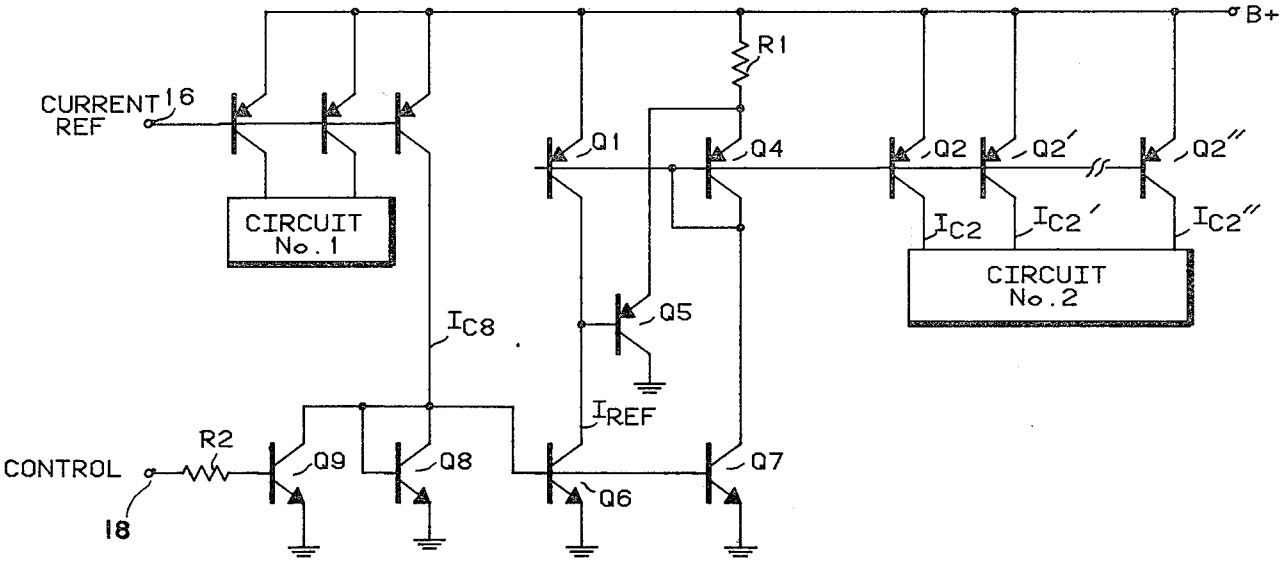
FIG. 4 is a schematic diagram of an application of the circuit of FIG. 3.

FIG. 4 shows a typical use of a current mirror in an IC design where the mirror circuit of FIG. 3 is used to transfer a current reference level from an NPN transistor to a series of PNP transistors. With prior art circuits, separate current reference circuits would have been required for biasing various chains of interconnected current source transistors due to the beta sensitivity problem.

In this application, a current reference at a terminal 16, which is used in Circuit No. 1 is also needed for Circuit No. 2. As may be seen in FIG. 4, the Q2 of FIG. 3 may actually be any desired number of transistors Q2, Q2', etc. The current sources supplying $I_{REF}$ and $I_{BIAS}$ are here shown as PNP transistors Q6 and Q7, respectively, but Q6 functions with Q8 as a conventional current mirror (similar to that of FIG. 1), using the current reference from terminal 16. $I_{REF}$ may be made any desired fraction of $I_{C8}$ by ratioing the areas of Q6 and Q8, or by the use of Q9 and R2, diverting a portion of $I_{C8}$ from the base-emitter junction of Q8 and thus reducing $I_{REF}$ accordingly (this control including ON-OFF type control). This current diversion may be accomplished via a control terminal 18. The current in each individual current source transistor is accurately controlled and separate current reference circuits are no longer required. The elimination of the extra reference circuits results in significant savings in IC chip area and, therefore, in IC cost.

Thus, there has been shown and described a current mirror circuit for integrated circuit application particularly which will provide highly accurate reference currents with voltage supplies lower than 2 volts. While specific circuits and transistors have been shown as preferred, it will be obvious to those skilled in the art that other choices of transistors and arrangements thereof are possible and it is intended to cover all such as fall within the spirit and scope of the appended claims.

What is claimed is:

1. A current mirror circuit usable with a single cell voltage supply and comprising:
   - a voltage supply;
   - a reference voltage source;
   - first and second transistors of the same conductivity type with bases coupled together, the second transistor being coupled between the voltage supply and the reference voltage source and supplying an output current:
   - a first current reference source coupled to the first transistor means;
   - a resistor coupled to the voltage supply;
   - diode means coupled between the resistor and the bases of the first and second transistors;
   - an adjustable current source coupled between the bases of the first and second transistors and the reference voltage source; and
   - a third transistor of said same conductivity type coupled between the resistor and the reference voltage source for forcing the output current to be a direct function of a reference current provided by said first current reference source.

2. A current mirror circuit in accordance with claim 1 wherein the diode means is a fourth, diode-connected transistor.

3. A current mirror circuit in accordance with claim 1 wherein the first, second and third transistor means are PNP transistors.

4. A current mirror circuit in accordance with claim 1 wherein the first current reference source includes a second current mirror and a second current reference source coupled to the second current mirror.

5. A current mirror circuit in accordance with claim 4 wherein the first current reference source also includes control means for varying the current of the first current reference source with respect to the current of the second current reference source.

6. A current mirror circuit in accordance with claim 4 wherein the second current reference source includes transistors of said same conductivity type.

7. A current mirror circuit in accordance with claim 1 wherein the second transistor means comprises a plurality of transistors.

* * * * *